US006015286A

United States Patent [19]

Maruyama

[11] Patent Number: 6,015,286

[45] Date of Patent: Jan. 18, 2000

[54] INTERNAL-COMBUSTION TYPE OF GAS LIGHTER

[75] Inventor: Susumu Maruyama, Tokyo, Japan

[73] Assignee: Windmill Kabushiki Kaisha, Tokyo, Japan

[21] Appl. No.: 08/886,116

[22] Filed: Jun. 30, 1997

[30] Foreign Application Priority Data

Sep. 11, 1996 [JP] Japan ..... 8-240332

[51] Int. Cl.[7] ..... F23Q 2/167

[52] U.S. Cl. ..... 431/130; 431/153; 431/255; 431/344; 431/152

[58] Field of Search ..... 431/344, 355, 431/153, 255, 129, 132, 135, 130, 133, 134, 137, 152

[56] References Cited

U.S. PATENT DOCUMENTS

| | | | |
|---|---|---|---|
| 550,149 | 11/1895 | Ziegler . | |
| 1,818,471 | 8/1931 | Geauque . | |
| 2,688,240 | 9/1954 | Treiss et al. . | |
| 3,891,381 | 6/1975 | Moriya . | |
| 4,235,588 | 11/1980 | Tanaka . | |
| 4,419,072 | 12/1983 | Nakagawa et al. . | |
| 4,597,732 | 7/1986 | Yoshinaga . | |
| 5,466,149 | 11/1995 | Tsai | 431/344 |

FOREIGN PATENT DOCUMENTS

| | | |
|---|---|---|
| 63-91431 | 4/1988 | Japan . |

*Primary Examiner*—Carl D. Price

*Attorney, Agent, or Firm*—Nikaido, Marmelstein, Murray & Oram LLP

[57] ABSTRACT

An internal-combustion type of gas lighter is provided including a cylindrical lighter housing enclosing a lighter body having a fuel gas reservoir therein; a fuel gas ejection nozzle in communication with the fuel gas reservoir via a valve; a lid permitting ignition of a combustible mixture when open and preventing ignition when shut; an orifice member positioned downstream of the fuel gas ejection nozzle to increase the flow rate of fuel gas ejected from the fuel gas ejection nozzle; a mixing tube positioned downstream of the orifice member, the mixing tube having air injection apertures to suck air under a negative pressure caused by a jet flow of fuel gas from the orifice member, thereby providing a fuel gas-and-air combustible mixture; a diffuser positioned downstream of the mixing tube to decrease the flow rate of the combustible gas mixture and to diffuse the combustible mixture; an ignition actuator to operate a piezoelectric element for igniting the combustible mixture; a combustion cylinder positioned downstream of the diffuser to permit the complete combustion of the combustible mixture therein; a flame controller which controls the flow rate of the fuel gas supplied to the combustion cylinder; and an air injection controller, adjustable independently of the flame controller, for controlling the amount of air to be fed to the mixing tube, the air-injection controller having a thumb ring rotatably fixed to the cylindrical housing and operatively connected to an adjustable, apertured piece, rotatably fitted surrounding the mixing tube, and adjustable to place an aperture thereof in alignment with an air-injection aperture of the mixing tube.

4 Claims, 6 Drawing Sheets

INTERNAL-COMBUSTION TYPE OF GAS LIGHTER

BACKGROUND OF THE INVENTION

1. Field of the Invention

The present invention relates to an internal-combustion type of gas lighter in which ignition and combustion of a fuel gas-and-air combustible mixture can be effected within the gas lighter body, thereby assuring that the ignition and combustion of the fuel gas-and-air combustible mixture can be effected without failure even in the worst condition in which, for instance, a strong wind blows at seaside. Such an internal-combustion type of gas lighter must be fail-safe, specifically guaranteed to be free of inadvertent ignition or explosion at ignition.

2. Description of Related Art

One example of an internal-combustion type of gas lighter is disclosed in Japanese patent 63-91431(A). As shown in FIG. 10, it comprises a fuel gas ejection nozzle 30, an orifice member 31, a mixing tube 32, a diffuser 33, and a combustion cylinder 34. These parts are arranged in the order named as seen downstream from the fuel gas ejection nozzle 30. The orifice member 31 has a throttle aperture 31*a* made at its center to increase the flow rate of the fuel gas ejecting from the nozzle 30. The mixing tube 32 draws air through its air-injection apertures 32*a* under the negative pressure, which is caused by the jet of the fuel gas from the throttle aperture 31*a* of the orifice member 31. Thus, a fuel gas-and-air combustible mixture is provided. The diffuser 33 decreases the flow rate of the fuel gas-and-air combustible mixture to diffuse the combustible mixture in the combustion cylinder 34. The diffusion of combustible mixture is ignited by an igniter 35 such as a discharge electrode in the combustion cylinder 34 to establish a flame extending from the combustion cylinder 34 like a burner. Thus, the complete combustion of the combustible mixture is attained.

The ignition and combustion of a fuel gas-and-air mixture can be effected within the gas lighter body to establish an extended flame like a burner, thereby assuring the ignition and combustion of the fuel gas-and-air mixture while a strong wind blows. It, however, cannot work satisfactorily at high altitudes where the air contains less oxygen than at low altitudes. Accordingly the fuel gas-and-air combustible mixture has such a reduced amount of oxygen that ignition is difficult.

Also disadvantageously, it forms a strong flame like a burner and, therefore, there is a fear of children getting burned by mishandling the internal-combustion type of gas lighter. Sometimes, even adults may get burned by inadvertent ignition, which is caused for instance, by touching the gas lighter in a pocket or bag. Once the thumb actuator has been inadvertently depressed to allow the fuel gas to leak into the enclosed space of the lid of the gas lighter, it may be possible that subsequent ignition of the fuel gas within the closed space causes an explosion in front of one's face.

SUMMARY OF THE INVENTION

One object of the present invention is to provide an internal-combustion type of gas lighter which is capable of igniting a fuel gas-and-air combustible mixture at high altitudes as well as at low altitudes.

Another object of the present invention is to provide an internal-combustion type of gas lighter which is guaranteed free of inadvertent ignition or fear of explosion at ignition.

To attain these objects an internal-combustion type of gas lighter comprising: a fuel gas ejection nozzle; an orifice member positioned downstream of the fuel gas ejected nozzle to increase the flow rate of fuel gas ejected from the fuel gas ejection nozzle; a mixing tube positioned downstream of the orifice member to suck air through its air-injection apertures under the negative pressure caused by jet flow of the fuel gas from the orifice member for providing a fuel gas-and-air combustible mixture; a diffuser positioned downstream of the mixing tube to decrease the flow rate of the combustible mixture and diffuse the combustible mixture; and a combustion cylinder positioned downstream of the diffuser to permit the complete combustion of the combustible mixture therein, is improved in that it further comprises air-injection control means.

With this arrangement the fuel gas from the fuel gas ejection nozzle increases its flow rate by passing through the orifice member, and at the same time, air is drawn through the air-injection aperture of the mixing tube under the negative pressure caused by jet flow of the fuel gas from the orifice member for providing a fuel gas-and-air combustible mixture. The fuel gas-and-air combustible mixture is allowed to diffuse in the combustion cylinder where it is ignited to establish an elongated flame like a burner. The fuel gas-to-air ratio of the combustible mixture can be controlled most in accordance with the surrounding environment such as high altitudes or windy seashore.

The air-injection control means may comprise a thumb ring rotatably fixed to the housing of the gas lighter and an adjustable piece, which is responsive to rotation of the thumb ring for turning in a predetermined direction.

With this arrangement the fuel gas-to-air ratio of the combustible mixture can be controlled with ease simply by rotating the thumb ring in the predetermined direction.

The adjustable piece may be a hollow cylinder having an aperture made therein, the hollow cylinder being so rotatably fitted on the mixing tube that the aperture of the hollow cylinder may be put in alignment with the air-injection aperture of the mixing tube while the hollow cylinder turns around the mixing tube. Thus, the air-inlet area can be controlled continuously in terms of the amount by which the aperture of the hollow cylinder is superposed on the air-injection aperture of the mixing tube.

The gas lighter further comprises flame control means to control the flow rate at which the fuel gas is supplied to the combustion cylinder, the flame control means being rotatably attached to the housing of the gas lighter.

The fine control of flame can be attained by the flame control means when used in combination with the air-injection control means.

The gas lighter further comprises a lock mechanism responsive to the closing of the lid for preventing ignition of the combustible mixture, and responsive to the opening of the lid for permitting ignition of the combustible mixture.

With this arrangement, inadvertent, dangerous misuse of the gas lighter can be prevented.

The lock mechanism may comprise a latch piece displaceable between rising and falling positions, the latch piece being spring-biased toward the rising position in which the latch piece is allowed to partly appear on the top of the lighter housing by opening the lid of the gas lighter, permitting ignition of the combustible mixture whereas the latch piece yieldingly descending to the falling position by closing the lid of the gas lighter, preventing ignition of the combustible mixture.

The automatic switching between the locking and unlocking positions can be attained simply by closing and opening the lid of the gas lighter.

Other objects and advantages of the present invention will be understood from the following description of an internalcombustion type of gas lighter according to one preferred embodiment of the present invention, which is shown in accompanying drawings.

DESCRIPTION OF THE PREFERRED EMBODIMENTS

Figure 1:
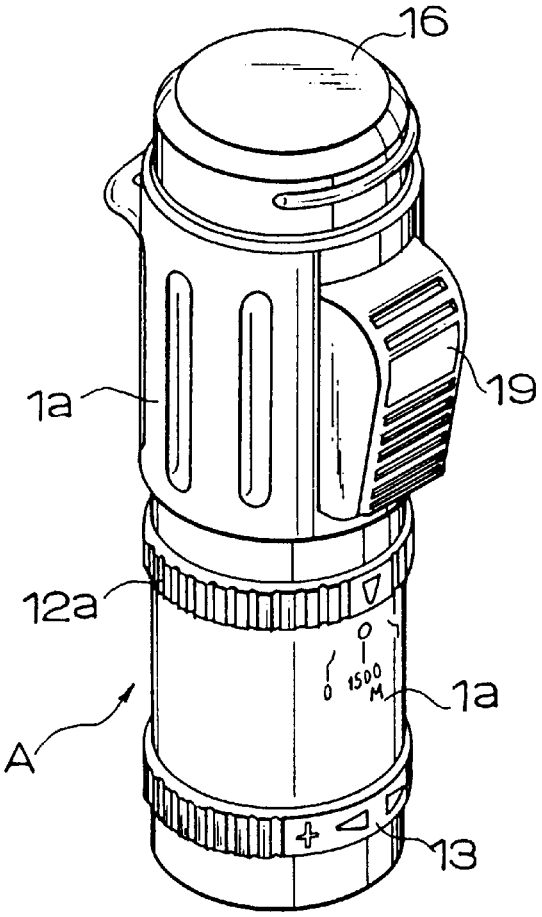
FIG. 1 is a perspective view of the internal-combustion type of gas lighter with its lid closed.
Figure 2:
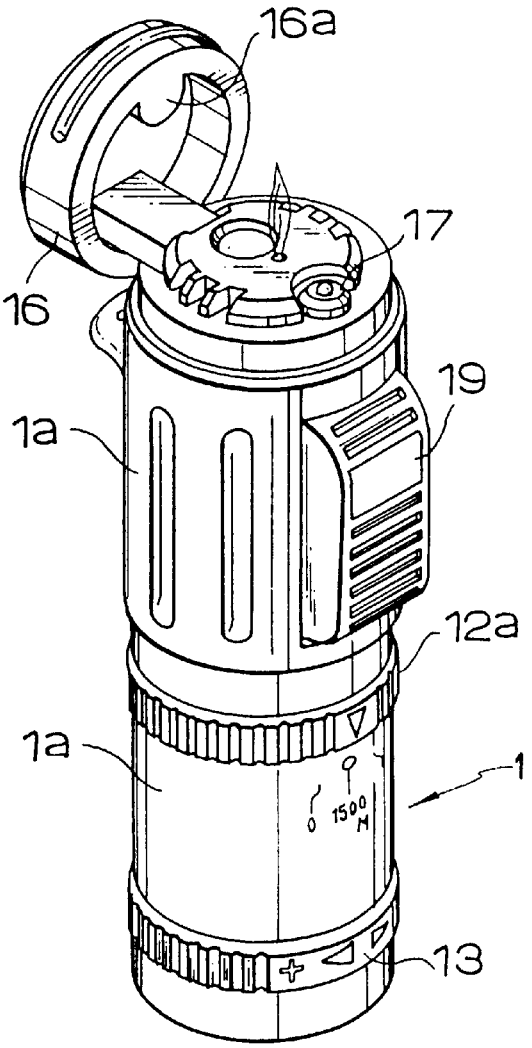
FIG. 2 is a perspective view of the internal-combustion type of gas lighter with its lid open.
Figure 3:
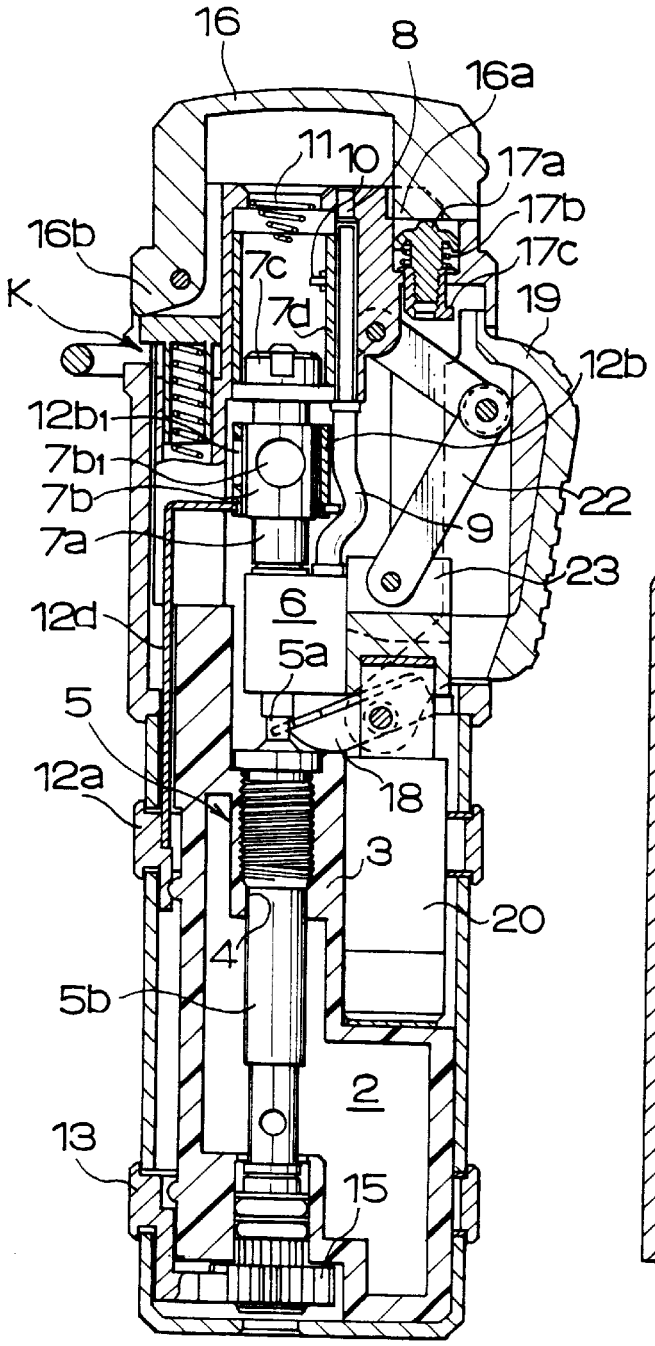
FIG. 3 is a longitudinal section of the internal-combustion type of gas lighter.

Referring to FIGS. 1 to 3, an internal-combustion type of gas lighter "A" according to the present invention includes a lighter body 1 enclosed with an enclosure casing 1*a*, and the lighter body 1 has a gas reservoir 2 formed therein (see FIG. 3), and the gas reservoir 2 has a tapped hole 4 made in its top section 3.

The top section 3 has a valve 5 threadedly engaged in the tapped hole 4, which communicates with the gas reservoir 2. The valve 5 has a fuel gas ejection nozzle 5*a* projecting from its top, and an annular skirt 5*b* extending down to the inside of the gas reservoir 2. The fuel gas ejection nozzle 5*a* is designed to be pulled out for ejection of fuel gas.

The neck of the fuel gas ejection nozzle 5*a* is engaged with one end of a valve-actuating lever 18 (see FIG. 3), which is swingable up and down about its pivot as later described. When the fuel gas ejection nozzle 5*a* is raised in response to the upward swing of the valve-actuating lever 18, the neck of the fuel gas ejection nozzle 5*a* is pulled out to open the valve for ejection of fuel gas.

An internal-combustion mechanism 7 (FIG. 4) is placed downstream of the fuel gas ejection nozzle 5*a* via an associated fuel gas divider 6. The fuel gas divider 6 has a main channel 6*a* communicating with the fuel gas ejection nozzle 5*a* and the internal-combustion mechanism 7, and a sub-channel 6*b* branching from the main channel 6*a* and communicating with a flame-visible cylinder 8 via an associated hollow tube 9 (see FIG. 3). A fine-meshed filter "F" is placed at the bottom of an apertured box nut 6*c*, which is inverted and threadedly engaged with the cylindrical neck of the fuel gas divider 6.

When the fuel gas ejection nozzle 5*a* is pulled up to its opening position, the fuel gas flows from the fuel gas ejection nozzle 5*a* to the internal-combustion mechanism 7 via the main channel 6*a*, and at the same time, to the flame-visible cylinder 8 via the sub-channel 6*b*. The former gas passage constitutes a burner-like flame establishing channel whereas the latter gas passage constitutes a visible flame establishing channel. The gas lighter can establish a burner-like flame and a visible flame simultaneously, and hence it is called "Double-Flame, Internal-Combustion Type of Gas Lighter".

Figure 4:
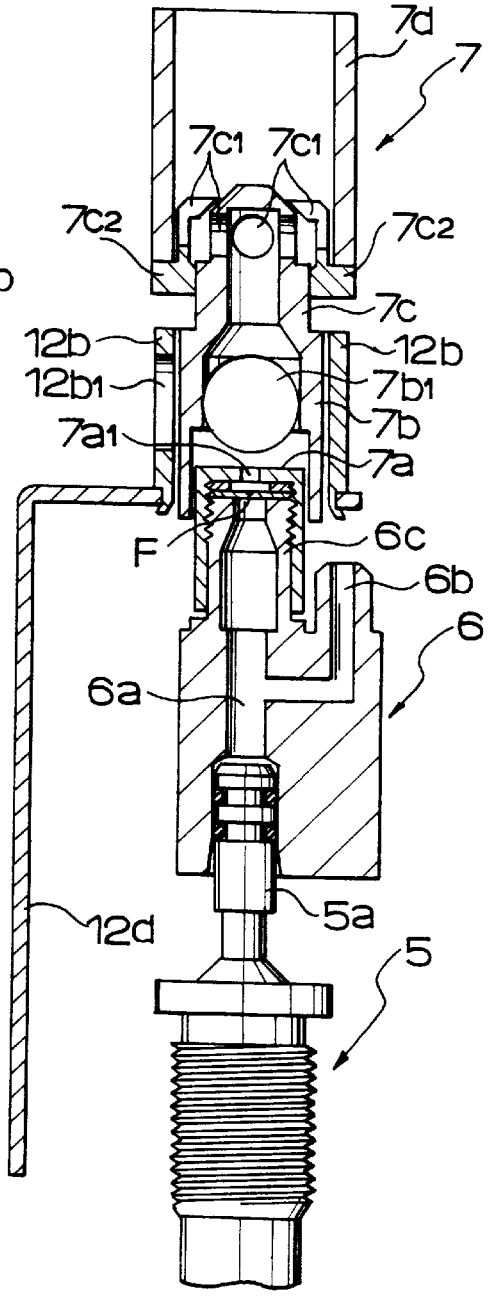
FIG. 4 is a longitudinal section of some selected parts of the gas lighter.

Referring to FIG. 4, the internal combustion mechanism 7 comprises an orifice member 7*a* fixed to the neck or annular projection 6*c* of the fuel gas divider 6, a mixing tube 7*b* hanging over the orifice member 7*a*, a diffuser 7*c* integrally connected to the top of the mixing tube 7*b* and a combustion cylinder 7*d* hanging over the diffuser 7*c*.

The orifice member 7*a* is a box nut having an aperture (orifice) $7a_1$ made in its bottom, thereby accelerating the fuel gas flow by allowing the fuel gas to forcibly pass through the narrow orifice $7a_1$.

The mixing tube 7*a* is a hollow cylinder, defining an upward converging channel. The hollow cylinder hangs over the orifice member 7*a*, and can be adjustably raised or lowered by sliding on the orifice member 7*a*.

The mixing tube 7*b* has an air-injection hole $7b_1$, to permit the suctioning of air from the surrounding under the negative pressure, which is caused by the gas stream flowing through the orifice $7a_1$ of the orifice member 7*a* at an increased speed, thereby enhancing the mixing of the fuel gas with air to provide a fuel gas-and-air combustible mixture.

The diffuser 7*c* is integrally connected to the top of the mixing tube 7*b*, and it has a plurality of diffusing holes $7c_1$ made radially on its circumference. The fuel gas-and-air combustible mixture from the mixing tube 7*b* flows in the diffuser 7*c* to impinge on the ceiling, thereby causing turbulence within the diffuser 7*c*. Thus, the mixing of the fuel gas with air is expedited, and then the combustible mixture is allowed to diffuse in the combustion cylinder 7*d* after passing through the diffusing holes $7c_1$.

The hollow combustion cylinder 7*d* stands upright on the top collar $7c_2$ of the diffuser 7*c*, and it has a discharge electrode 10 attached to its inner wall via an insulator and a catalyst 11 fixed to its outlet. The catalyst 11 will be heated red by the flame extending like a burner flame.

Figure 5:
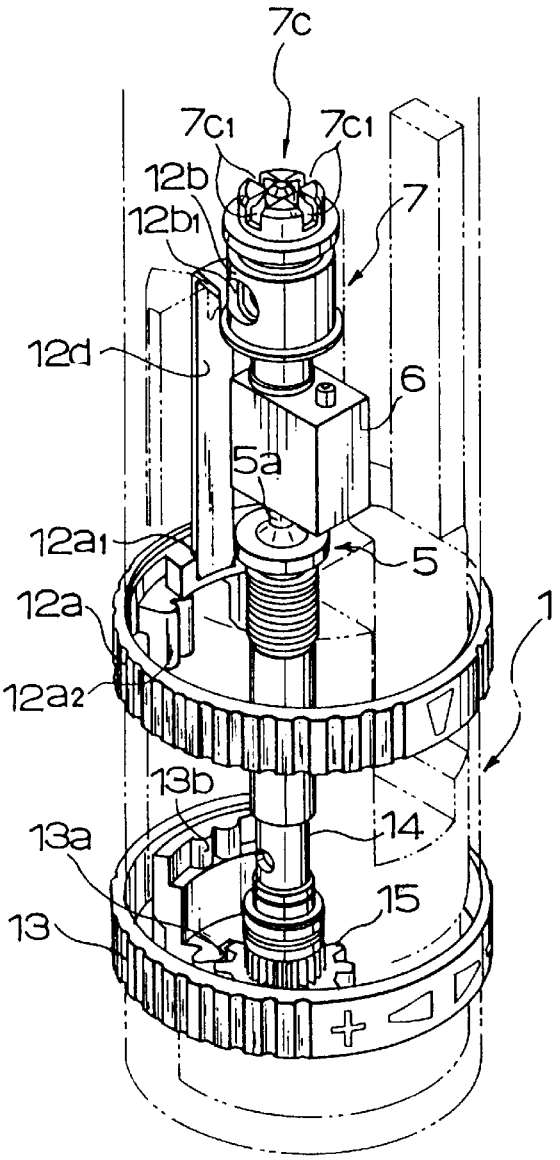
FIG. 5 is a perspective view of some selected parts of the gas lighter.

Referring to FIGS. 4 and 5, air-injection control means 12 is connected to the outer circumference of the mixing tube 7*b* for controlling the amount of air to be fed to the mixing tube 7*b*. It comprises a thumb ring 12*a* rotatably fixed to the housing 1*a* of the gas lighter body 1 and an adjustable cylindrical piece 12*b*, which is responsive to rotation of the thumb ring 12*a* for turning in a predetermined direction.

Figure 9:
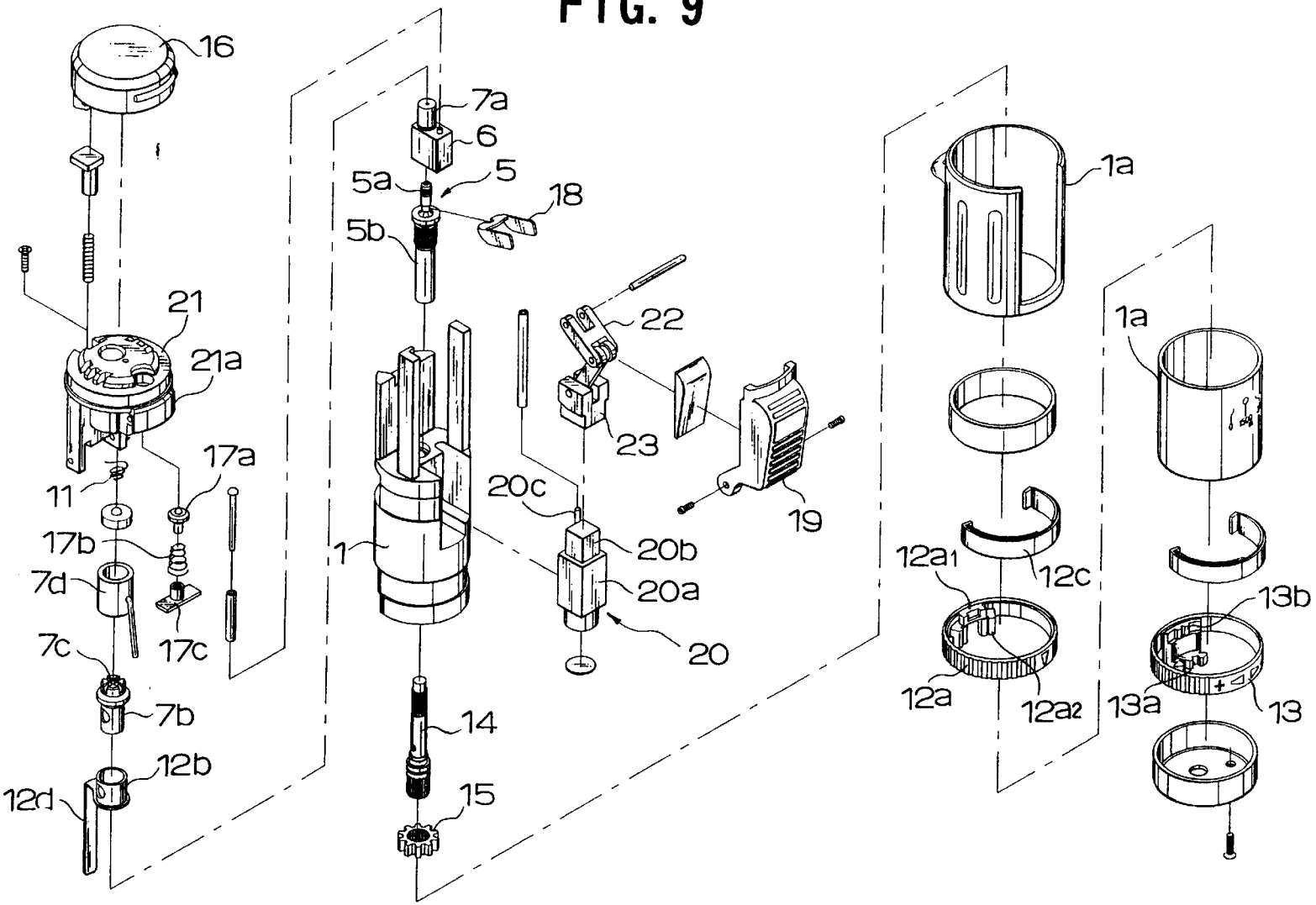
FIG. 9 is an exploded view of the gas lighter.
Figure 10:
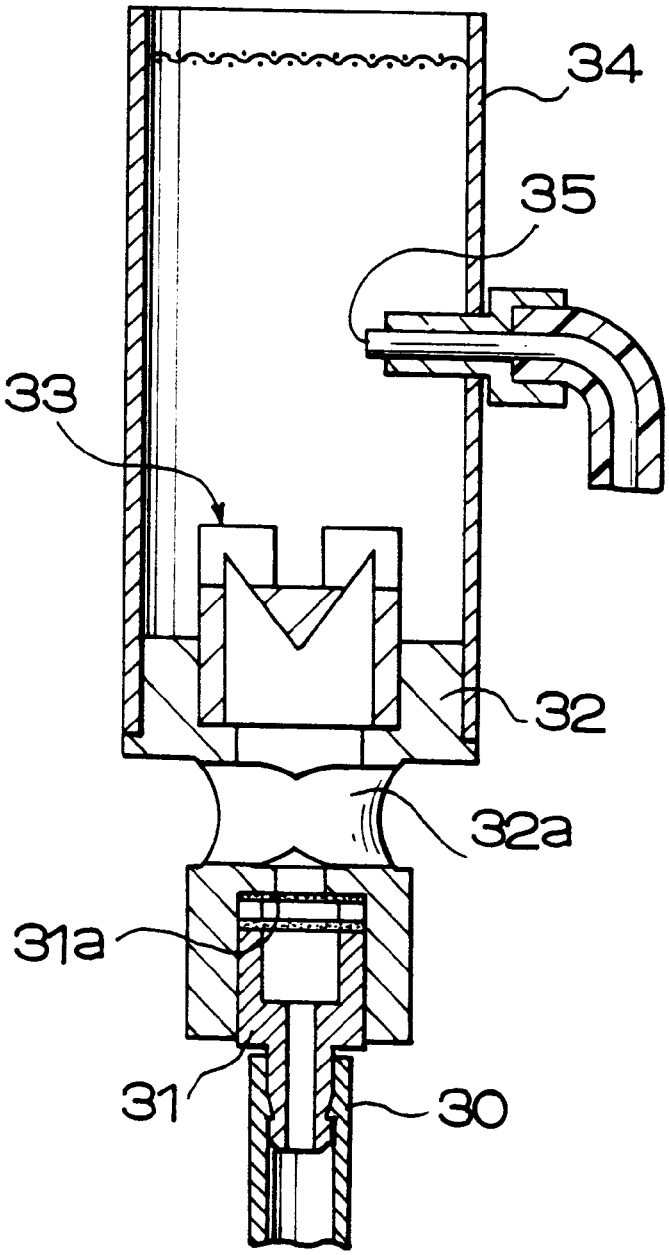
FIG. 10 PRIOR ART
FIG. 10 is a longitudinal section of some selected parts of a conventional internal-combustion type of gas lighter.

The thumb ring 12*a* is rotatably fixed to the housing 1*a* via an associated arc-shaped piece 12*c* (see FIG. 9). The housing 1*a* has indications 0M, 1,500M and 3,000M to indicate altitudes (see FIG. 1). The adjustable cylindrical piece 12*b* has an aperture $12b_1$ made thereon, and is rotatably fitted on the mixing tube 7*b* to permit its aperture aperture $12b_1$ to be put in alignment with the air-suction aperture $7b_1$ of the mixing tube 7*b*.

The adjustable cylindrical piece 12*b* has a hook-like rod 12*d* depending therefrom and fitted in the recess $12a_1$ of the thumb ring 12*a* to form a gang of rotary assembly, as best seen from FIG. 3. Specifically the opening area of the air-inlet $7b_1$ can be adjusted by rotating the thumb ring 12*a*, and hence the adjustable cylindrical piece 12*b* about the mixing tube 7*b*.

Figure 6A:
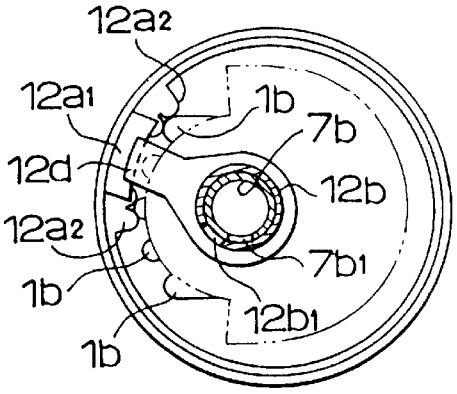
FIG. 6*a* illustrates the misalignment position in which the aperture of the hollow cylinder is apart from alignment with the air-injection aperture of the mixing tube.
Figure 6B:
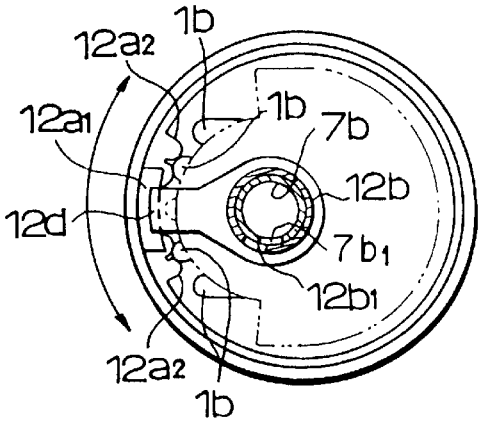
FIG. 6*b* illustrates the partial-alignment position in which the aperture of the hollow cylinder is put partly in alignment with the air-injection aperture of the mixing tube.
Figure 6C:
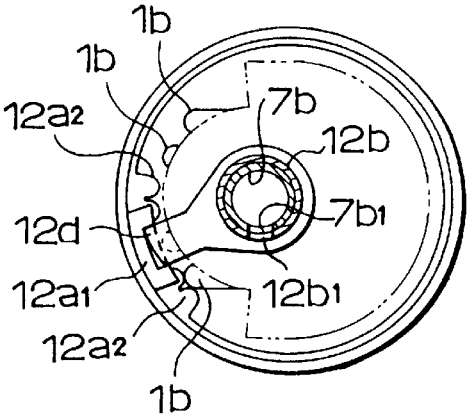
FIG. 6*c* illustrates the alignment position in which the aperture of the hollow cylinder is put in alignment with the air-injection aperture of the mixing tube.

Referring to FIG. 6, the air-inlet $7b_1$ of the mixing tube 7*b* is fully closed when the adjustable aperture $12b_1$ is apart from the air-inlet 7*b* (see FIG. 6*a*), thereby permitting the adjustable cylinder 12*b* to close the air-inlet 7*b* of the mixing tube 7*b*; the air-inlet $7b_1$ of the mixing tube 7*b* is partly closed when the adjustable aperture $12b_1$ is partly in alignment with the air-inlet 7*b* (see FIG. 6*b*); and the air-inlet $7b_1$ of the mixing tube 7*b* is fully opened when the adjustable aperture $12b_1$ is put in alignment with the air-inlet 7*b* (see FIG. 6*c*). Thus, the amount of air to be drawn in the mixing tube 7*b* can be controlled continuously as desired.

Flame control means includes an adjustable ring 13, which is rotatably fixed to the housing of the lighter body 1 at a level lower than the air-injection control means 12. The flame control ring 13 is like the thumb ring 12*a* of the air-injection control means 12, and can control the flow rate of the fuel gas to the fuel gas ejection nozzle 5*a*, and hence the flame size, depending on how far the adjustable ring 13 is rotated.

As seen from FIG. 5, the adjustable ring 13 has an upper rack-and-lower pawl, 13*b* and 13*a*, respectively formed inside, and a gearwheel 15 fixed to a liquefied petroleum gas suction member 14, which gearwheel 15 meshes the lower pawl 13*a*. The amount of the fuel gas to be supplied to the fuel gas ejection nozzle 5*a* can be controlled by rotating the adjustable ring 13, thereby rotating the liquefied petroleum gas suction member 14 via the pawl-and-ratchet connection.

Figure 7:
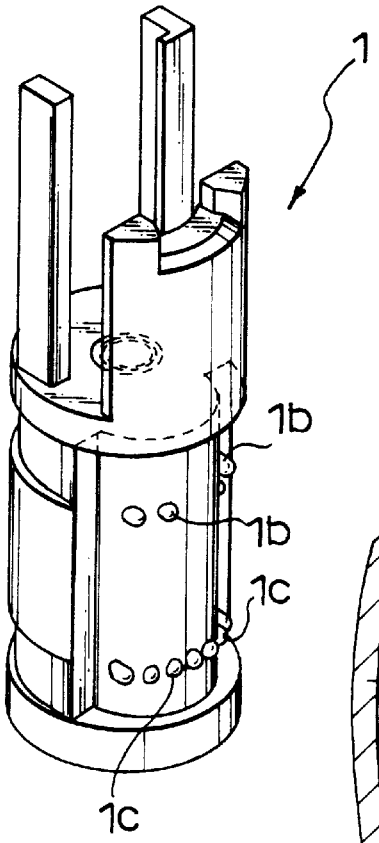
FIG. 7 is a perspective view of a lighter body of the internal-combustion type of gas lighter.

Referring to FIG. 7, the lighter body 1 has semi-spherical projections 1*b* . . . , and 1*c* . . . arranged at regular intervals at upper and lower levels to mesh the indentations $12a_2$ of the inner surface of the air-injection adjustable thumb ring 12*a* and the indentations 13*b* of the inner surface of the flame-adjustable ring 13 (see FIG. 5), thus clicking for each incremental rotation of the air-injection adjustable or flame adjustable thumb ring and permitting it to stop at a desired position and stay there in stable condition.

Figure 8:
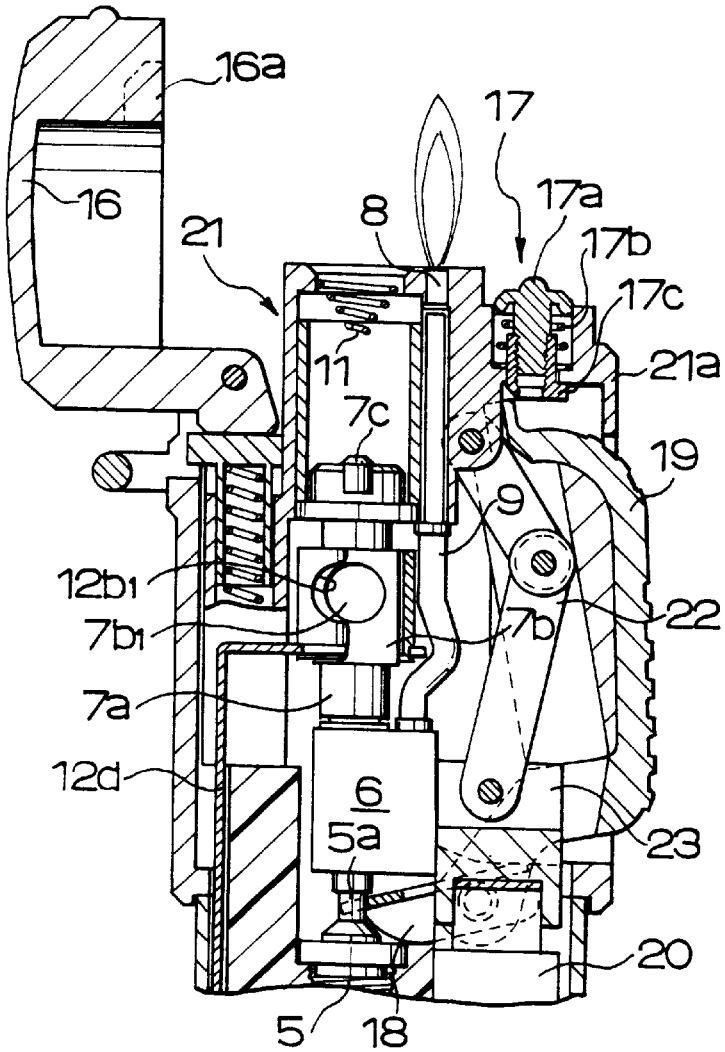
FIG. 8 is a longitudinal section of some selected parts of the gas lighter with its lid open.

Referring to FIGS. 3 and 8, the lighter body 1 has a lock mechanism 17 responsive to the closing of the lid 16 for preventing the ignition of combustible mixture, and responsive to the opening of the lid 16 for permitting the ignition of combustible mixture. Specifically the lock mechanism 17 includes a latch piece 17*a* displaceable between rising and falling positions. The latch piece 17*a* is spring-biased to the rising position in which the latch piece 17*a* is allowed to partly appear on the top of the housing by opening the lid 16 of the gas lighter, permitting the ignition of combustible mixture (see FIG. 8) whereas the latch piece 17*a* yieldingly descends to the falling position by closing the lid 16 of the gas lighter, preventing the ignition of combustible mixture (see FIG. 3).

As best seen from FIG. 2, the lid 16 has an abutment 16*a* formed inside of the lid 16. The abutment 16*a* will abut against the latch piece 17*a* to push it down when the lid 16 is closed.

As seen from FIG. 8, when the lid 16 is opened, the spring-biased latch piece 17*a* is allowed to rise in unlocking position where the lower end 17*c* of the latch piece 17*a* is put in non-engagement with the top end of the ignition actuator 19, thereby permitting the operation of the ignition actuator 19 when depressed. When the lid 16 is closed, the spring-biased latch piece 17*a* is yieldingly lowered to locking position where the lower end 17*c* of the latch piece 17*a* is put in engagement with the top end of the ignition actuator 19 (see FIG. 3), thus preventing depression of the ignition actuator 19.

As seen from FIG. 3, the lighter body 1 has a snap bolt "K" provided just below the pivot 16*b* of the lid 16 in usual way, thereby preventing the lid from being inadvertently opened before being unaware, and giving a pleasing opening-and-closing operation.

The ignition mechanism includes, along with the ignition actuator 19, a valve operating lever 18 whose one end is connected to the neck of the fuel gas ejection nozzle 5*a*, and a piezoelectric unit 20 responsive to depression of the ignition actuator 19 for operation (see FIGS. 3 and 8). The piezoelectric unit 20 includes an outer box 20*a* and an inner box 20*b* telescoping in the outer box 20*a* (see FIG. 9), and the inner box 20*b* contains a piezoelectric element, a hammer, a return spring and other associated parts (not shown). An electric wire 20*c* extends from one electrode of the piezoelectric element to the discharge electrode 10, which is insulated from the lighter housing. The other electrode of the piezoelectric element is electrically connected to the combustion cylinder 7*d* via an articulated arm 22 of metal.

The lower end of the ignition actuator 19 is rotatably fixed to the gas lighter body 1, and the top of the ignition actuator 19 is caught by the descendent extension 21*a* of the top section 21 of the gas lighter body. One end of the articulated arm 22 is rotatably connected to the top section 21 of the gas lighter body, and the other end of the articulated arm 22 is rotatably connected to a sliding block 23. The articulated arm 22 is bent with its elbow joint abutting against the ignition actuator 19, as seen from FIGS. 3 and 8.

Depression of the ignition actuator 19 into the top section 21 of the gas lighter body will unbend the articulated arm 22, thereby pushing down the sliding block 23 along the side of the fuel gas divider 6. Then, the inner box 20*b* is pushed in the outer box 20*a* to cause a high-voltage to appear between the opposite electrodes of the piezoelectric element, and at the same time, the neck of the fuel gas ejection nozzle 5*a* is pulled out to cause ejection of the fuel gas from the nozzle 5*a*.

In case of ignition, first the lid is raised with thumb, and then the actuator 19 is depressed inward with thumb, thereby unbending the articulated arm 22, applying a pushing force to the piezoelectric element until an electric discharge appears between the discharge electrode 10 and the outlet of the diffuser 7*c*. At the same time, the neck of the fuel gas nozzle 5*a* is raised by the valve operating lever 18 until the valve opens to allow the fuel gas to eject, which fuel gas has already risen from the reservoir 2 via the liquefied petroleum gas suction member 14.

The fuel gas from the fuel gas ejection nozzle 5*a* increases its flow rate by passing through the slit $7a_1$ of the orifice member 7*a*, and at the same time, air is drawn through the air-injection apertures $7b_1$ of the mixing tube 7*b* under the negative pressure caused by ejection of the fuel gas from the orifice member 7*a* for providing a fuel gas-and-air combustible mixture. The fuel gas-and-air combustible mixture is allowed to diffuse in the combustion cylinder 7*d* through the diffuser 7*c*. Specifically the combustible mixture impinges on the ceiling of the mixing tube 7*b* to throw back, thus expediting the mixing of the fuel gas with the air sucked into the mixing tube 7*b*. The combustible mixture is allowed to flow and diffuse in the combustion cylinder 7*d* through the diffusing apertures $7c_1$ of the diffuser 7*c*. At the instant that the combustible mixture is diffused in the combustion cylinder 7*d*, the combustible mixture is ignited to form an elongated flame like a burner.

Apart from the flow of combustible mixture another flow of fuel gas is permitted to the flame-visible cylinder 8 via the hollow tube 9, and then the fuel gas is ignited by the burner flame from the adjacent combustion cylinder 7*d* to form a visible flame simultaneously.

The air-injection adjustable thumb ring 12*a* may be rotated to change the opening aperture area of the air-injection aperture 7*b*, of the mixing tube 7*b*, accordingly controlling the fuel gas-to-air ratio of the combustible mixture so as to be most appropriate for the surrounding condition such as high altitudes or a windy seashore.

Also, the flame-adjustable thumb ring 13 may be rotated to control the flow rate of fuel gas so as to attain the fine control of flame when used in combination with the air-injection adjustable thumb ring 12*a*.

The automatic switching between the locking and unlocking positions can be attained in response to the closing and opening of the lid 16 of the gas lighter. Particularly when the lid 16 is closed, the spring-biased latch piece 17*a* is yieldingly lowered to locking position where the lower end 17*c* of the latch piece 17*a* is put in engagement with the top end of the ignition actuator 19, thereby preventing depression of the ignition actuator 19. Thus, inadvertent, dangerous misuse of the gas lighter can be effectively prevented.

It should be understood that the present invention be not limited to the internal-combustion type of gas lighter described above because various modifications of parts are possible, as is apparent to those skilled in the art.

What is claimed is:

1. An internal-combustion type of gas lighter comprising:

a cylindrical lighter housing enclosing a lighter body having a fuel gas reservoir therein;

a fuel gas ejection nozzle in communication with the fuel gas reservoir via a valve;

a lid permitting ignition of a combustible mixture when open and preventing ignition when shut;

an orifice member positioned downstream of the fuel gas ejection nozzle to increase the flow rate of fuel gas ejected from the fuel gas ejection nozzle;

a mixing tube positioned downstream of the orifice member, said mixing tube having air injection apertures to suck air under a negative pressure caused by a jet flow of fuel gas from the orifice member, thereby providing a fuel gas-and-air combustible mixture;

a diffuser positioned downstream of the mixing tube to decrease the flow rate of the combustible gas mixture and to diffuse the combustible mixture;

an ignition actuator to operate a piezoelectric element for igniting the combustible mixture;

a combustion cylinder positioned downstream of the diffuser to permit the complete combustion of the combustible mixture therein;

a flame controller which controls the flow rate of the fuel gas supplied to the combustion cylinder; and an air injection controller, adjustable independently of the flame controller, for controlling the amount of air to be fed to the mixing tube, the air-injection controller having a thumb ring rotatably fixed to the cylindrical housing and operatively connected to an adjustable, apertured piece rotatably fitted surrounding the mixing tube, and adjustable to place an aperture thereof in alignment with an air-injection aperture of the mixing tube.

2. An internal-combustion type of gas lighter according to claim 1, wherein the flame controller is rotatably attached to the housing of the gas lighter.

3. An internal-combustion type of gas lighter according to claim 1, wherein the thumb ring of the air-injection controller is connected to the adjustable, apertured piece by a hook-like rod.

4. An internal-combustion type of gas lighter according to claim 1, further comprising a lock mechanism responsive to closing of the lid for preventing ignition of fuel gas and responsive to opening of the lid for permitting ignition of fuel gas, said lock mechanism comprising a latch piece displaceable between an open position and a closed position, said latch piece being spring-biased toward the open position, in which said latch piece partly appears on the top of the housing by opening the lid of the gas lighter, thereby enabling the ignition actuator and permitting ignition of combustible mixture, and the latch piece yieldingly descending to the closed position by closing the lid of the lighter, thereby disabling the ignition actuator and preventing the ignition of combustible mixture.

* * * * *